US008562377B2

(12) United States Patent
Kawamura

(10) Patent No.: US 8,562,377 B2
(45) Date of Patent: Oct. 22, 2013

(54) SHIELD CONNECTOR HAVING A SHIELD SHELL CONNECTED TO A METALLIC CASE AND A SHIELD CONDUCTOR

(75) Inventor: Masayuki Kawamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/442,963

(22) Filed: Apr. 10, 2012

(65) Prior Publication Data

US 2012/0270444 A1 Oct. 25, 2012

(30) Foreign Application Priority Data

Apr. 19, 2011 (JP) ..... 2011-093054

(51) Int. Cl.
*H01R 9/03* (2006.01)

(52) U.S. Cl.
USPC ..... 439/607.44

(58) Field of Classification Search
USPC ..... 439/607.44, 607.41, 607.45, 578, 587, 439/271
See application file for complete search history.

(56) References Cited

U.S. PATENT DOCUMENTS

| | | | | |
|---|---|---|---|---|
| 3,819,849 | A * | 6/1974 | Baker | 174/86 |
| 6,837,728 | B2 * | 1/2005 | Miyazaki et al. | 439/271 |
| 7,351,098 | B2 * | 4/2008 | Gladd et al. | 439/578 |
| 7,384,312 | B2 * | 6/2008 | Van Der Mee et al. | 439/607.44 |
| 7,597,589 | B2 * | 10/2009 | Kawamura | 439/595 |
| 7,934,950 | B2 | 5/2011 | Yong | |
| 8,083,545 | B2 * | 12/2011 | Koitabashi et al. | 439/607.01 |
| 8,221,164 | B1 * | 7/2012 | Lazaro, Jr. | 439/607.41 |
| 2009/0130901 | A1 * | 5/2009 | Aoki et al. | 439/587 |
| 2012/0142214 | A1 * | 6/2012 | Kawamura | 439/571 |
| 2013/0084728 | A1 * | 4/2013 | Omae et al. | 439/271 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A shield connector (10) is mounted in a metal case (C) that contains a device to be mounted in a vehicle. The shield connector (10) has a housing (30) in which terminal fittings (20) connected to ends of wires (W) are accommodated and from which the wires (W) are pulled out. Rubber plugs (70) are provided for sealing between the inner peripheries of cavities (31) in the housing (30) and the outer peripheries of the wires (W). A shield shell (50) covers the housing (30) and is connected electrically to the case (C) and also to a shield conductor (60) through which the wires (W) are inserted. A second rubber ring is provided between the housing (30) and the shield shell (50).

14 Claims, 5 Drawing Sheets

SHIELD CONNECTOR HAVING A SHIELD SHELL CONNECTED TO A METALLIC CASE AND A SHIELD CONDUCTOR

BACKGROUND OF THE INVENTION

1. Field of the Invention

The invention relates to a shield connector.

2. Description of the Related Art

U.S. Pat. No. 7,934,950 discloses a shield connector to be connected to a device mounted in a vehicle. The device is in a metal case and the shield connector is mounted to the metal case. The shield connector includes a housing for holding terminal fittings connected to wires. The wires are pulled out from the housing and a rubber seal provides sealing between the outer peripheries of the wires and the inner periphery of the housing. A tubular shield shell is mounted on the housing to cover the outer surface of the housing.

The shield shell is connected electrically to the case and a shield conductor, such as a braided wire, covers the wires pulled out from the housing to provide shielding from the case to the shield conductor.

A shield connector used outside a vehicle may be weathered and water may penetrate into the inside of the shield shell through a clearance between the housing and the shield shell. A rubber ring prevents water that has penetrated into the inside of the shield shell from entering the interior of the housing by a rubber ring. However, water penetrates toward the shield conductor through the inside of the shield shell.

The invention was completed based on the above and an object thereof is to prevent penetration of water toward a shield conductor through the inside of a shield shell.

SUMMARY OF THE INVENTION

The present invention is directed to a shield connector to be mounted in a metal case that contains a device to be mounted in a vehicle. The shield connector includes a housing. A terminal fitting connected to an end of a wire is accommodated in the housing and the wire is pulled out from the housing. A shield shell covers the housing. One end of the shield shell is connected electrically to the case and the other end is connected electrically to a shield conductor made of metal and surrounding the wire pulled out from the housing. A first seal member provides sealing between the wire and the housing and a second seal member is provided between the housing and the shield shell to provide sealing between the housing and the shield shell.

The first seal member prevents water from penetrating into the housing through a clearance between the housing and the wire while the second seal member prevents water from penetrating into the inside of the shield shell through a clearance between the housing and the shield shell. Thus water cannot penetrate toward the shield conductor through the inside of the shield shell.

The shield conductor may be formed by electrically connecting a plurality of types of metals having different standard electrode potentials. Thus, the shield conductor may be formed by using a metal having high strength at a position where strength is required and using an easily deformable metal at a position where bending deformation is required. Electrolytic corrosion occurs if an electrolyte solution, such as moisture, is present in a part where different types of metals having different standard electrode potentials are connected. Thus, both metals are dissolved in the form of ions into water and corrosion progresses by an electrochemical reaction. However, the second seal member prevents water from penetrating through a clearance between the housing and the shield shell and into a part where different types of metals having different standard electrode potentials are connected. Thus, electrolytic corrosion is not likely to occur between different types of metals having different standard electrode potentials.

DETAILED DESCRIPTION OF THE PREFERRED EMBODIMENT

Figure 4:
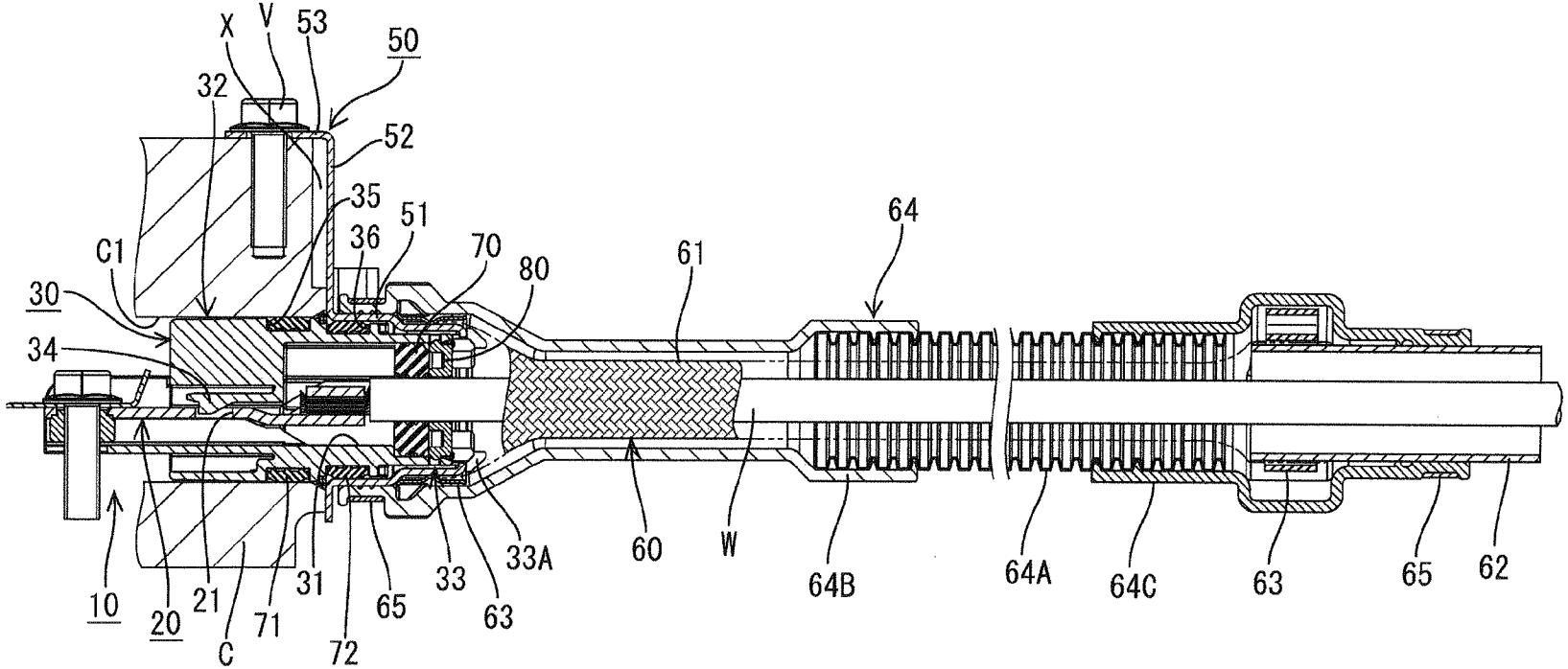
FIG. 4 is a section along V-V of FIG. 3.

A shield connector in accordance with the invention is identified by the numeral 10 in FIG. 4 and is to be mounted in a mounting hole C1 in a metal case C that contains a device.

Figure 1:
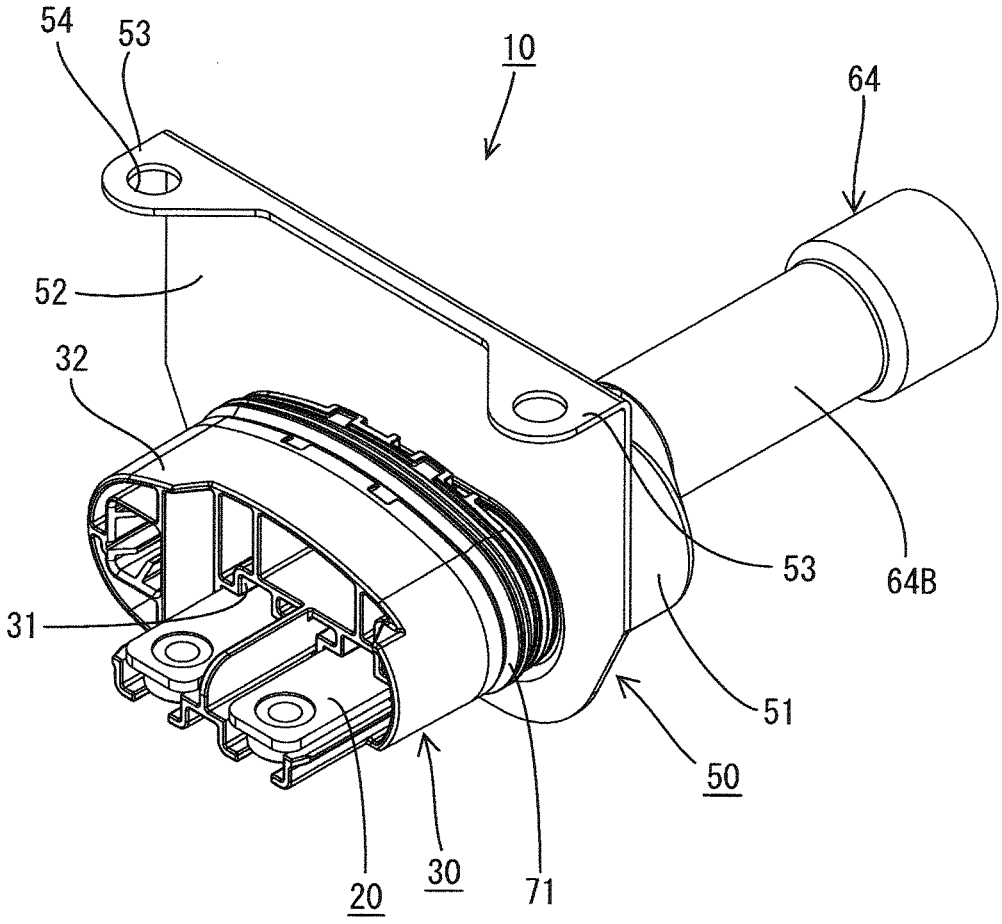
FIG. 1 is a perspective view showing a state where a first rubber boot is mounted on a shield connector.

As shown in FIG. 1, the shield connector 10 includes a housing 30 made of synthetic resin. Terminal fittings 20 connected to ends of wires W are accommodated in the housing 30 and a shield shell 50 covers the housing 30.

Figure 2:
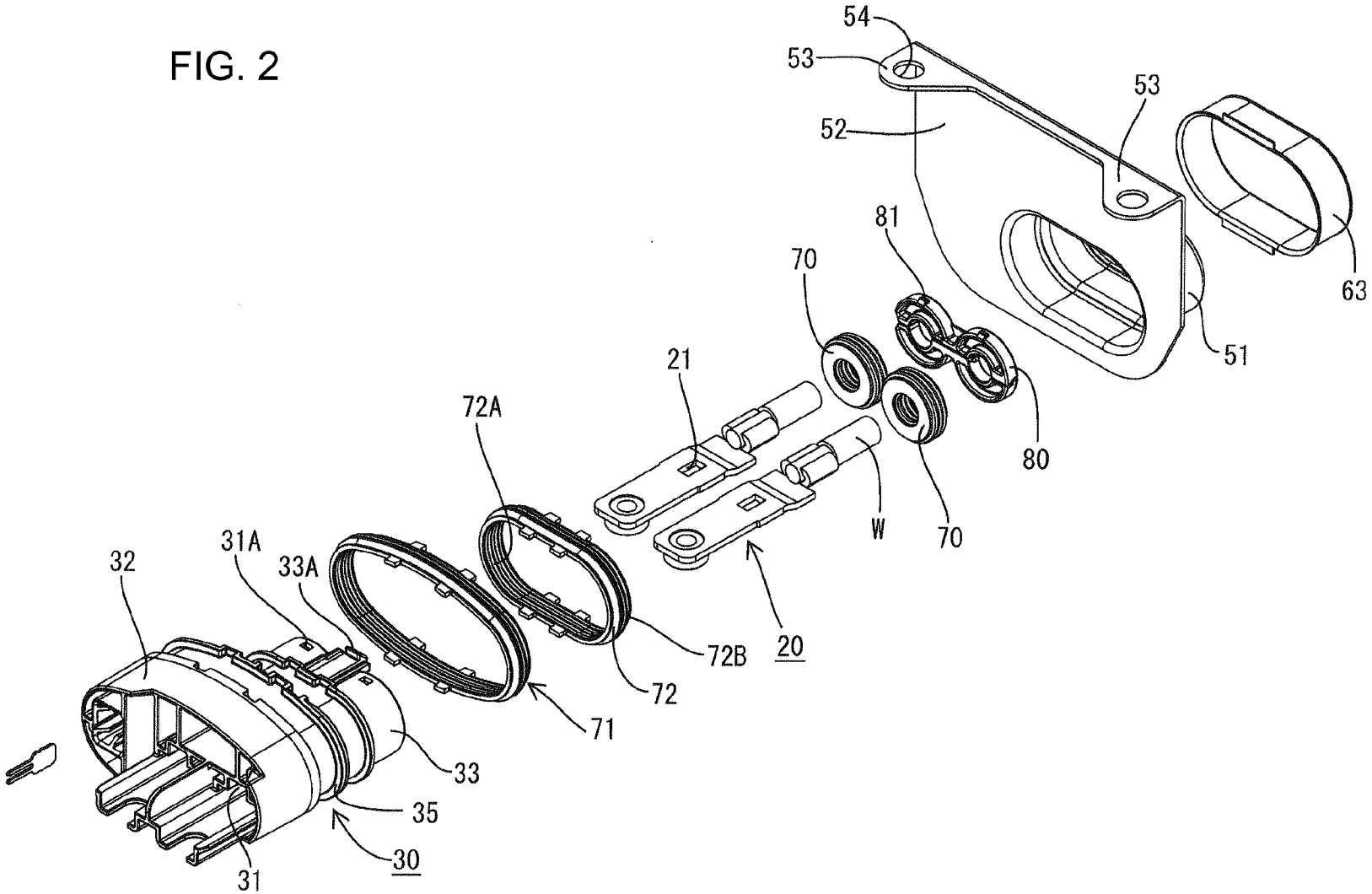
FIG. 2 is an exploded perspective view of the shield connector.
Figure 5:
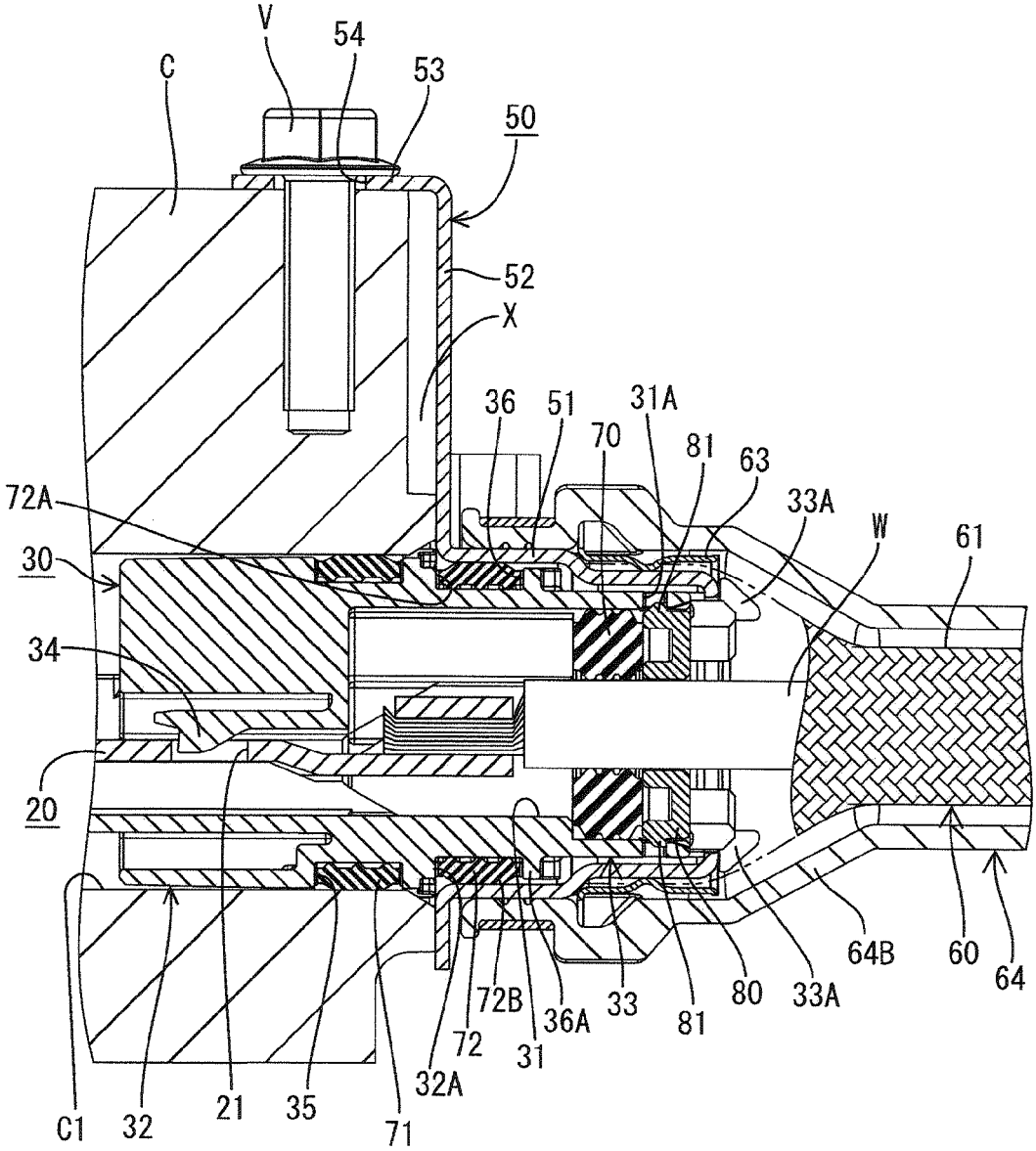
FIG. 5 is an enlarged section showing an essential part of FIG. 4.

Each terminal fitting 20 is a flat plate and the wire W is connected electrically conductively to a rear part of the terminal fitting 20, as shown in FIGS. 2 and 5. Further, a locking hole 21 vertically penetrates a substantially central part of the terminal fitting 20 in forward and backward directions.

The housing 30 is a wide flat tube that is hollow in forward and backward directions, as shown in FIG. 2. The housing 30 has a large elliptical housing portion 32 at the front end and a small elliptical housing portion 33 at the rear end. The major axes of both elliptical housing portions 32, 33 extend in the width direction.

The large elliptical portion 32 can fit into the mounting hole C1 of the case C, as shown in FIG. 5. A first mounting groove 35 is formed over the entire circumference of the outer peripheral surface of the large elliptical housing portion 32 and can receive an elliptical first rubber ring 71, as shown in FIGS. 2 and 5.

The first rubber ring 71 closely contacts the bottom wall of the first mounting groove 35 (outer peripheral surface of the large housing portion 32) and the inner peripheral surface of the mounting hole C1, as shown in FIG. 5, to seal between the outer peripheral surface of the large housing portion 32 and the inner peripheral surface of the mounting hole C1 in a watertight manner when the large housing portion 32 is fit into the mounting hole C1 of the case C. Thus, water cannot penetrate into the interior of the case C from the outside.

On the other hand, the small housing portion 33 has its major axis extending in the width direction and is shifted laterally with respect to the large housing portion 32, as shown in FIGS. 2 and 5.

Resiliently deformable locking claws 33A are formed at widthwise central parts of upper and lower sides of a rear end of the small elliptical portion 33.

Cavities 31 penetrate through the large and small portions 32 and 33 of the housing 30 in forward and backward directions and are disposed side by side in the width direction, as shown in FIGS. 2 and 5.

The terminal fittings 20 are insertable into the cavities 31 from behind, as shown in FIG. 5. A resiliently deformable locking lance 34 is cantilevered forward in each cavity 31 and can engage the locking hole 21 of the terminal fitting 20 in forward and backward directions to hold the terminal fitting 20 in the cavity 31. Further, the wire W connected to the terminal fitting 20 is pulled out through the rear opening of the cavity 31.

An annular rubber plug 70 is mounted in the rear end opening of each cavity 31 and closely contacts the inner peripheral surface of the cavity 31 and the outer peripheral surface of the wire W, as shown in FIG. 5. The plug 70 provides watertight sealing between the inner peripheral surface of the cavity 31 and the outer peripheral surface of the wire W. Thus, water cannot penetrate into the cavity 31 through the rear end opening of the cavity 31.

A back retainer 80 is arranged behind the rubber plugs 70, as shown in FIGS. 2 and 5. The back retainer 80 comprises two half members that are assembled to sandwich the wires W from upper and lower sides. Retaining projections 81 are provided on upper and lower sides of the back retainer 80 and retaining holes 31A vertically penetrate upper and lower sides of the rear end opening of each cavity 31. The retaining projections 81 engage the retaining holes 31A in forward and backward directions to hold the back retainer 80 in the housing 30 so as not to come out backward. Further, the back retainer 80 contacts the rear end surfaces of the rubber plugs 70 and collectively retains the rubber plugs 70 in the housing 30.

As shown in FIGS. 2 and 5, the shield shell 50 includes a tubular shell main body 51 for covering the outer peripheral surface of the small housing portion 33 and an extending piece 52 radially extending from the front opening edge of the shell main body 51. Note that the shield shell 50 is formed by press-working a metal plate material as a base material, and the shell main body 51 is formed by spinning relative to the extending piece 52.

The shell main body 51 has an elliptical cross-section and the small housing portion 33 fits into the shell main body 51, as shown in FIG. 5. The shell main body 51 substantially completely covers the housing 30 exposed from the case C when the shell main body 51 and the small housing portion 33 reach a properly connected state. Thus, the shell main body 51 covers the terminal fittings 20 and the wires W held in the cavities 31 of the housing 30.

As shown in FIG. 5, a front part of the shell main body 51 contacts a step portion 32A between the large and small housing portions 32 and 33 to prevent further forward movement, and the locking claws 33A of the small housing portion 33 lock a rear part of the shell main body 51. Thus, the shield connector 50 is held and prevented from moving in forward and backward directions with respect to the housing 30.

Mounting pieces 53 project forward from the upper end of the extending piece 52 at each widthwise side of the extending piece 52, as shown in FIG. 1. Further, bolt insertion holes 54 vertically penetrate the mounting pieces 53, as shown in FIGS. 1 and 5. Bolts V are inserted into the bolt insertion holes 54 and tightened into the case C for reliably mounting and fixing the shield connector 10 to the case C and electrically connecting the shield shell 50 to the case C.

A shield conductor 60 is mounted behind the shell main body 51 of the shield shell 50 and covers the wires W pulled out backward from the cavities 31 of the housing 30, as shown in FIG. 4.

As shown in FIG. 4, the shield conductor 60 includes a braided wire 61 electrically connected to a rear end part of the shell main body 51 of the shield shell 50 and a shield pipe 62 electrically connected to a rear end part of the braided wire 61.

The braided wire 61 is formed into a tubular shape by braiding copper or copper alloy strands, and the wires W are insertable into the braided wire 61. As shown in FIG. 5, a front part of the braided wire 61 is mounted on the rear part of the shell main body 51 and is connected electrically to the shell main body 51 by crimping a metal crimp ring 63. Further, the braided wire 61 is flexible and bendable in any arbitrary direction. Tin plating is applied to the surfaces of the strands of the braided wire 61 to suppress oxidation and rusting.

As shown in FIG. 4, the shield pipe 62 is a cylinder made of aluminum or aluminum alloy, and the wires W are inserted into the shield pipe 62. A rear end part of the braided wire 61 is mounted on the front end part of the shield pipe 62 and is connected electrically to the braided wire 61 by crimping the metal crimp ring 63. The shield pipe 62 protects the wires W inserted therein from water and interference from external matter.

The wires W pulled out backward from the cavities 31 of the housing 30 are inserted into the braided wire 61 and the shield pipe 62, as shown in FIG. 4, and shielded together by the braided wire 61 and the shield pipe 62.

As shown in FIG. 4, a substantially cylindrical protector 64 made of synthetic resin is mounted in a part where the braided wire 61 is arranged. The protector 64 includes a flexible bellows-like corrugated tube 64A, a substantially cylindrical first rubber boot 64B mounted on a front part of the corrugated tube 64A and a substantially cylindrical second rubber boot 64C mounted on a rear part of the corrugated tube 64A. Unillustrated inner lips are provided on the inner peripheral surface of a rear opening part of the first rubber boot 64B and closely contact the outer peripheral surface of the front part of the corrugated tube 64A to prevent water from penetrating through a clearance between the first rubber boot 64B and the corrugated tube 64A. Similarly, unillustrated inner lips are provided on the inner peripheral surface of a front opening part of the second rubber boot 64C and closely contact the outer peripheral surface of the rear part of the corrugated tube 64A to prevent water from penetrating through a clearance between the second rubber boot 64C and the corrugated tube 64A.

Figure 3:
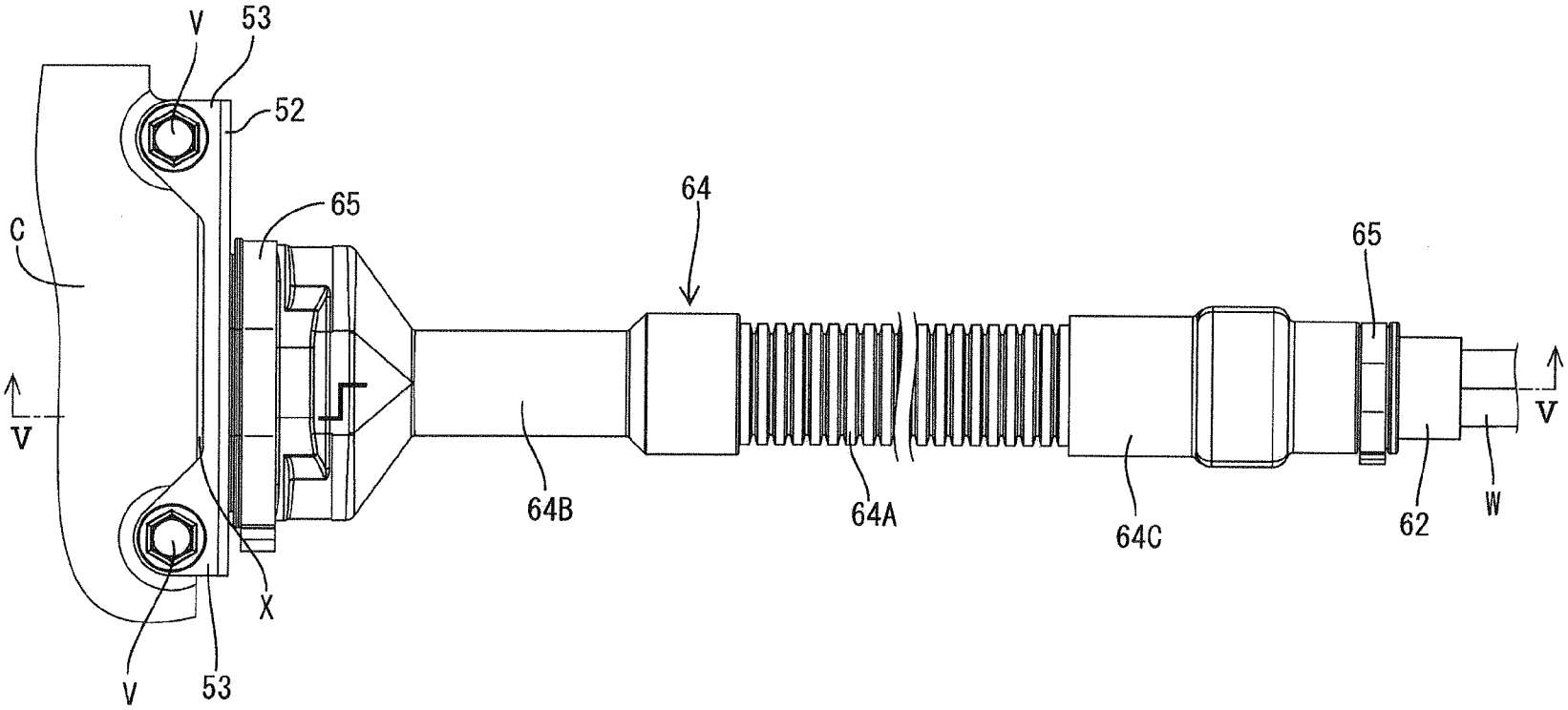
FIG. 3 is a plan view showing a state where the shield connector is connected to a case of a device and a shield conductor.

As shown in FIGS. 3 and 4, the front opening part of the first rubber boot 64B is fit into the shell main body 51 to cover the front part of the braided wire 61 and the crimp ring 63 and is fixed by a tightening band 65 to prevent water from penetrating through a clearance between the shell main body 51 and the first rubber boot 64B. On the other hand, the second rubber boot 64C is fit into the front part of the shield pipe 62 to cover the rear part of the braided wire 61 and the crimp ring 63 and is fixed by the tightening band 65 to prevent water from penetrating through a clearance between the shell main body 51 and the second rubber boot 64C. Thus, the wires W pulled out backward from the cavities 31 of the housing 30 are covered together by the shield pipe 62 and the protector 64 and are protected from water, interferences from external matters and the like.

The wires W are protected from water, interferences from external matters and the like by the shield pipe 62 at a position where light weight and strength are necessary and by the flexible braided wire 61 and corrugated tube 64A at a position where bending deformation in any arbitrary direction is necessary. Thus, the shield conductor 60 easily can be arranged in an appropriate form in the vehicle by linking the braided wire 61 and the shield pipe 62 according to need.

A second mounting groove 36 is formed over the entire circumference of the outer peripheral surface of the small housing portion 33 and accommodates a second rubber ring 72, as shown in FIG. 5.

This second rubber ring 72 provides watertight sealing between the outer peripheral surface of the small housing portion 33 and the shell main body 51 when the small housing portion 33 of the housing 30 and the shell main body 51 of the shield shell 50 are connected.

The second mounting groove 36 is formed in a recess between the step 32A at the boundary between the large and small housing portions 32 and 33 and a flange 36A bulging out from a substantially central part of the small housing portion 33 over the entire periphery. Thus, the second mounting groove 36 is before the substantially central part of the small housing portion 33 in forward and backward directions.

On the other hand, as shown in FIGS. 2 to 5, the second rubber ring 72 is elliptical and projects slightly from the second mounting groove 36. Inner lips 72A are formed around the inner peripheral surface of the second rubber ring 72 and closely contact the bottom surface of the second mounting groove 36 (outer peripheral surface of the small housing portion 33). Similarly, outer lips 72B are formed around the entire outer peripheral surface of the second rubber ring 72 and closely contact the inner peripheral surface of the shell main body 51.

The inner lips 72A of the second rubber ring 72 closely contact the bottom surface of the second mounting groove 36 (outer peripheral surface of the small housing portion 33) and the outer lips 72B of the second rubber ring 72 closely contact the inner peripheral surface of the shell main body 51 at a front part of the small housing portion 33 to provide watertight sealing between the small housing portion 33 and the shell main body 51 when the small housing portion 33 and the shell main body 51 are connected. Thus, water that may have passed through a clearance X between the case C and the extending piece 52 of the shield shell 50 cannot penetrate into the shell main body 51 through a clearance between the small housing portion 33 and the shell main body 51.

To prevent penetration of water through a clearance between the housing 30 and the shield shell 50, it is thought to provide sealing between the case C and the shield shell 50. However, in this case, a space used to mount a surface seal or the like is necessary around the mounting hole C1 of the case C and the shield shell 50 needs to be strongly pressed against the case C. In order to strongly press the shield shell 50 against the case C, it is generally thought to fix the shield shell 50 to the case C by screws or bolts in a connecting direction (forward and backward directions). However, according to such a method, a space used to tighten screws or bolts in the connecting direction is further necessary at an outer peripheral part of the surface seal. If such a space cannot be ensured, the shield shell 50 cannot be pressed against the case C in the connecting direction and sealing between the case C and the shield shell 50 is reduced. However, the second rubber ring 72 is provided between the small housing portion 33 and the shell main body 51 in this embodiment. This is effective when there is no space to mount a surface seal or the like at the outer peripheral part of the mounting hole C1 of the case C and to tighten screws, bolts or the like in the connecting direction.

The tin plating of the braided wire 61 may be removed in a part where the braided wire 61 connected behind the shield shell 50 and the shield pipe 62 are crimped by the crimp ring 63. The braided wire 61 and the shield pipe 62 are connected directly if the tin plating is removed. Aluminum and copper have different standard electrode potentials. Hence, an electrolyte solution adheres to a connected part of the braided wire 61 and the shield pipe 62 when salt contents mixed in dust, sand or the like adhere and further moisture adheres in the connected part of the braided wire 61 and the shield pipe 62. As a result, electrolytic corrosion occurs and corrosion progresses by an electrochemical reaction in the part where the electrolyte solution adheres. However, in this embodiment, the protector 64 prevents water from penetrating through a clearance between the shield shell 50 and the shield pipe 62 and the second rubber ring 72 prevents water from penetrating through a clearance between the small elliptical portion 33 and the shell main body 51. Thus, water cannot penetrate to the connecting part of the braided wire 61 and the shield pipe 62. Consequently, electrolytic corrosion is suppressed in the connecting part of the braided wire 61 and the shield pipe 62.

The invention is not limited to the above described and embodiment. For example, the following embodiments also are in the scope of the invention.

Although the second rubber ring 72 is mounted on the front part of the small elliptical portion 33 in the above embodiment, the invention is not limited to such a mode. For example, the second rubber ring 72 may be mounted on the central or rear part of the small elliptical portion 33 in forward and backward directions.

Although rubber plugs 70 are mounted in each cavity 31 in the above embodiment, the invention is not limited to such a mode. For example, a one-piece rubber plug for sealing plural cavities 31 together may be mounted.

Although the second seal member is the second rubber ring 72 formed with the inner lips 72A and the outer lips 72B in the above embodiment, the second seal member may be an O-ring.

Although the shield conductor 60 is composed of the braided wire 61 and the shield pipe 62 in the above embodiment, the invention is not limited to such a mode. For example, the shield conductor 60 may be only of the shield pipe 62 and the shield pipe 62 may be connected directly to the shield shell 50.

Although the second seal member is the second rubber ring 72 mounted on the outer peripheral surface of the small housing portion 33 in the above embodiment. However, the second seal member may be a surface brought into surface contact with the housing 30 and the shield shell 50 in forward and backward directions.

What is claimed is:

1. A shield connector to be mounted in a metal case containing a device to be mounted in a vehicle, comprising:

a housing;

at least one terminal fitting accommodated in the housing;

at least one wire connected to the terminal fitting and extending from the housing;

a shield conductor made of metal and surrounding the wire pulled out from the housing;

a shield shell covering the housing, a first end of the shield shell being connected electrically to the case and a second end thereof being connected electrically to the shield conductor;

at least one first seal member sealing between the wire and the housing; and a second seal member between the housing and the shield shell for sealing between the housing and the shield shell.

2. The shield connector of claim 1, wherein the shield conductor is formed by electrically connecting a plurality of types of metals having different standard electrode potentials.

3. The shield connector of claim 2, wherein the shield conductor comprises a first section that is bendable and a second section that is substantially rigid the first section having a front end connected to the shield shell and a rear end connected to the second section.

4. The shield connector of claim 3, wherein the first section of the shield conductor comprises a braided metal wire.

5. The shield connector of claim 4, wherein the braided metal wire is formed from copper or copper alloy strands.

6. The shield connector of claim 4, wherein the second section of the shield conductor is shield pipe.

7. The shield connector of claim 6, wherein the shield pipe is formed from aluminum or aluminum alloy.

8. The shield connector of claim 6, further comprising a corrugated resin tube and surrounding at least part of the braided metal wire.

9. The shield connector of claim 8, further comprising a first rubber boot surrounding the braided metal wire of the shield conductor and having a front end in close sealing contact with the housing and a rear end in close sealing contact with an outer peripheral surface of a front end of the corrugated resin tube and.

10. The shield connector of claim 9, further comprising a second rubber boot having a front end in close sealing contact with an outer peripheral surface of a rear end of the corrugated resin tube and a rear end in close sealing contact with an outer peripheral surface of the shield pipe.

11. The shield connector of claim 1, wherein the at least one terminal fitting comprises a plurality of terminal fittings and the at least one wire comprisesa plurality of wires connected respectively to the terminal fittings.

12. The shield connector of claim 7, wherein the at least one first seal member comprises a plurality of first seal members mounted respectively on the wires.

13. The shield connector of claim 1, wherein the second seal member is a rubber ring between an outer peripheral surface of the housing and an inner peripheral surface of the shield shell.

14. The shield connector of claim 1, further comprising at least one bolt connecting the shield shell to the case, the bolt extending in a direction transverse to a connecting direction of the housing to the case.

* * * * *